US009278803B2

(12) United States Patent
Fatrai et al.

(10) Patent No.: US 9,278,803 B2
(45) Date of Patent: Mar. 8, 2016

(54) RECEPTACLE

(71) Applicant: Hailo-Werk Rudolf Loh GmbH & Co. KG, Haiger (DE)

(72) Inventors: Alexander Fatrai, Biedenkopf (DE); Kasem Phetkhajee, Siegen (DE)

(73) Assignee: HAILO-WERK RUDOLF LOH GMBH & CO. KG (DE)

( * ) Notice: Subject to any disclaimer, the term of this patent is extended or adjusted under 35 U.S.C. 154(b) by 62 days.

(21) Appl. No.: 13/832,027

(22) Filed: Mar. 15, 2013

(65) Prior Publication Data

US 2014/0263349 A1 Sep. 18, 2014

(51) Int. Cl.

| | |
|---|---|
| ***B65D 25/14*** | (2006.01) |
| ***B65D 6/08*** | (2006.01) |
| ***B65F 1/14*** | (2006.01) |

(52) U.S. Cl.

CPC ..... *B65F 1/1646* (2013.01); *B65F 1/1607* (2013.01); *B65F 1/1615* (2013.01); *B65F 1/1623* (2013.01); *B65F 2250/11* (2013.01)

(58) Field of Classification Search

CPC ..... B65F 1/06; B65F 1/1607; Y10S 220/908; B65D 25/16

USPC ..... 220/495.11, 495.08, 324, 908, 254.3, 220/254.4, 908.1, 495.06; 248/99; 383/33

See application file for complete search history.

(56) References Cited

U.S. PATENT DOCUMENTS

| | | | | |
|---|---|---|---|---|
| 2,678,764 | A * | 5/1954 | Carlson | 141/390 |
| 4,444,355 | A * | 4/1984 | Cary | 229/125.13 |
| 4,913,308 | A * | 4/1990 | Culbertson | 220/495.09 |
| 5,662,238 | A * | 9/1997 | Sarno | 220/495.11 |
| 5,803,300 | A * | 9/1998 | DeMars | 220/495.11 |
| 2008/0173648 | A1 * | 7/2008 | Escobar et al. | 220/495.11 |
| 2009/0045198 | A1 * | 2/2009 | Kao et al. | 220/260 |
| 2009/0261105 | A1 * | 10/2009 | Cunningham et al. | 220/495.08 |
| 2010/0224627 | A1 * | 9/2010 | Yang et al. | 220/212 |

FOREIGN PATENT DOCUMENTS

EP 1686072 A1 2/2005

* cited by examiner

*Primary Examiner* — Shawn M Braden

(74) *Attorney, Agent, or Firm* — Edell, Shapiro & Finnan, LLC

(57) ABSTRACT

A waste receptacle includes a housing with an opening at least on one side and a holding frame for refuse bags which is placed removably at least indirectly on an edge of the opening of the housing. The receptacle may further include a cover frame.

10 Claims, 14 Drawing Sheets

RECEPTACLE

FIELD OF THE INVENTION

The present invention relates to receptacles and, in particular, a waste receptacle.

BACKGROUND

Waste receptacles are generally known. In one conventional waste receptacle, a cover frame is placed on the edge of the opening. This cover frame has four openings. Into each of these openings there can be introduced a refuse bag whose edge is for this purpose folded over an edge of the opening of the cover frame. The holding frame is then introduced into the refuse bag and placed on a flange on the cover frame that projects inwardly into the opening of the cover frame. Finally, the initially outwardly folded edge of the refuse bag is folded inwardly over the holding frame. A lid which is placed on the holding frame can be used to close an insertion opening for waste that is bounded by the holding frame.

After introducing the refuse bag, the latter, starting from the edge of its opening, is guided upwardly on the inner side of the holding frame. The refuse bag is then guided outwardly over the holding frame in order then to be guided on the outer side of the holding frame between the holding frame and the cover frame. The cover frame covers the outer side of the holding frame and the refuse bag pulled over the outer side of the holding frame. Neither the refuse bag nor the holding frame is visible from the side since they are covered by the cover frame. Finally, the refuse bag is guided on the underside of the holding frame between the holding frame and the already mentioned flange of the cover frame in the inward direction and from the inner end of the flange in the downward direction into the housing of the waste receptacle.

When the lid is closed, the latter rests on the upper side of the holding frame or the refuse bag guided over the upper side of the holding frame and on the upper side of the cover frame. The upper side of the holding frame and the refuse bag guided over it are then not visible. However, when the lid is opened, the refuse bag is visible. Likewise, a gap between the holding frame and the cover frame through which the refuse bag is guided is visible.

This conventional waster receptacle suffers from several disadvantages. The visibility of the refuse bag when the lid is opened, caused by guiding the refuse bag over the holding frame, is not desired by some users of waste receptacles, in particular in public areas also serving to make the right impression. This argument is all the more powerful since use is frequently made in public areas of waste receptacles in which the insertion opening is not closed by a lid so that it is also possible to dispose of waste in the waste receptacle when walking past. Thus, it would be desirable to provide a waste receptacle that avoids such drawbacks.

SUMMARY OF THE INVENTION

The present invention relates to a waste receptacle with a housing which has an opening at least on one side, with a holding frame for refuse bags which is placed removably at least indirectly on an edge of the opening of the housing, and with a cover frame.

The object of the invention is to develop a waste receptacle of the initially mentioned type such that as little as possible of the refuse bag is perceptible.

This object is achieved according to the invention in that the cover frame is placed removably on the holding frame and in that the cover frame covers an outer side and an upper side of the holding frame and a gap between the holding frame and the housing on an outer side of the waste receptacle.

Consequently, all the sides of the holding frame which are visible from outside or from above and over which the refuse bag is guided are covered by the cover frame.

Moreover, the cover frame can also cover at least a small part of the inner side of the holding frame and the refuse bag guided over it.

The cover frame can project beyond the gap between the holding frame and the housing by at least 0.5 cm.

The cover frame of a waste receptacle according to the invention can enclose an insertion opening which is suitable and designed for inserting waste into a refuse bag which can be fastened between the housing and the refuse bag holding frame and also between the holding frame and the cover frame. Unlike the waste receptacle disclosed in document EP 1 686 072 A1, the holding frame, where appropriate with the interposition of the refuse bag, is placed indirectly or directly on the housing and not on the cover frame which is situated above the holding frame. Instead, the cover frame is placed on the holding frame. The holding frame and a refuse bag guided over the holding frame can therefore be covered by the cover frame. The refuse bag is also substantially covered from above and is also not visible in the case of waste receptacles which do not have a lid. The refuse bag extends, as seen from the edge of the opening of the refuse bag, upwardly and past the inner side of the holding frame. The refuse bag is guided outwardly from the upper end of the inner side, specifically through between the upper side of the holding frame and the underside of the cover frame. The direction of the refuse bag changes at the outer edge of the upper side of the holding frame and it is guided downwardly along the outer side of the holding frame, it being covered by the cover frame. From the lower end of the outer side of the holding frame, the refuse bag is then guided inwardly through between the underside of the holding frame and the housing of the waste receptacle. It is then guided downwardly inside the housing.

A waste receptacle according to the invention can have a lid for closing the insertion opening. The lid can be pivotably mounted on the cover frame. It can also be placed removably on the cover frame.

The waste receptacle can have a mechanism which is suitable and designed for bringing the lid from a position in which the insertion opening is closed into a position in which the insertion opening can be used to insert waste. The mechanism can be triggered when pressure is exerted onto the lid on an opposite side thereof from a pivot pin.

Furthermore, it is possible that the lid is connected via a mechanism to a pedal which can be actuated to bring the lid from a closed position into an open position.

It is also possible that the lid is connected to a drive, for example a motor or the like, which can be activated to bring the lid from a closed position into an open position.

The holding frame can have a first frame portion which extends substantially parallel to a wall of the housing. This frame portion can preferably be adjoined in the direction of the cover frame by a second frame portion which is angled away outwardly with respect to the first frame portion. The angle between an inner side of the first frame portion and an inner side of the second frame portion can be 120° to 140°.

The holding frame can have a third frame portion which extends substantially perpendicularly to the first frame portion and which adjoins the first or, where appropriate, the second frame portion in an outwardly projecting manner.

The holding frame can have webs on an outer side of the first and, where appropriate, the second frame portion. The third frame portion preferably projects outwardly beyond these webs. As a result, an underside of the third frame portion is not covered by the webs and is available as a bearing surface for bearing the first frame portion on the housing of the waste receptacle.

The holding frame can have tabs which are extended inwardly from the first frame portion. These tabs can enclose, for example, an angle of 150° to 160° with the second frame portion. The tabs can extend over the second frame portion and be connected to the third frame portion.

It has proven to be advantageous if the third frame portion is reinforced in the region of the tabs in order to be able to absorb the bending of the tabs.

The cover frame of a waste receptacle according to the invention can have cantilever arms which press the tabs of the holding frame outwardly against the inner wall of the housing. As a result, a refuse bag can be clamped and thus frictionally fastened between the inner wall of the housing and the tab of the holding frame. At the same time, the holding frame and the cover frame are connected to the housing by a positive connection and/or frictional connection. The positive connection with the housing can be produced in particular in that the edge of the opening of the housing is undercut. The housing can have a bead on the inner side of the edge of the opening, and the tabs of the holding frame can project beyond this bead in the direction facing away from the opening of the housing, thus into the interior of the housing. As a result of the outward bending of the tabs by means of the cantilever arms of the cover frame, these are bent around the bead, it being possible for the cantilever arms to spring inwardly when placing the cover frame so that the bead can be overcome.

Features of the present invention are described by way of the following description of an exemplary embodiment with reference to the appended drawings, in which

BRIEF DESCRIPTION OF THE DRAWINGS

Like reference numerals have been used to identify like elements throughout this disclosure.

DETAILED DESCRIPTION OF THE INVENTION

Figure 1:
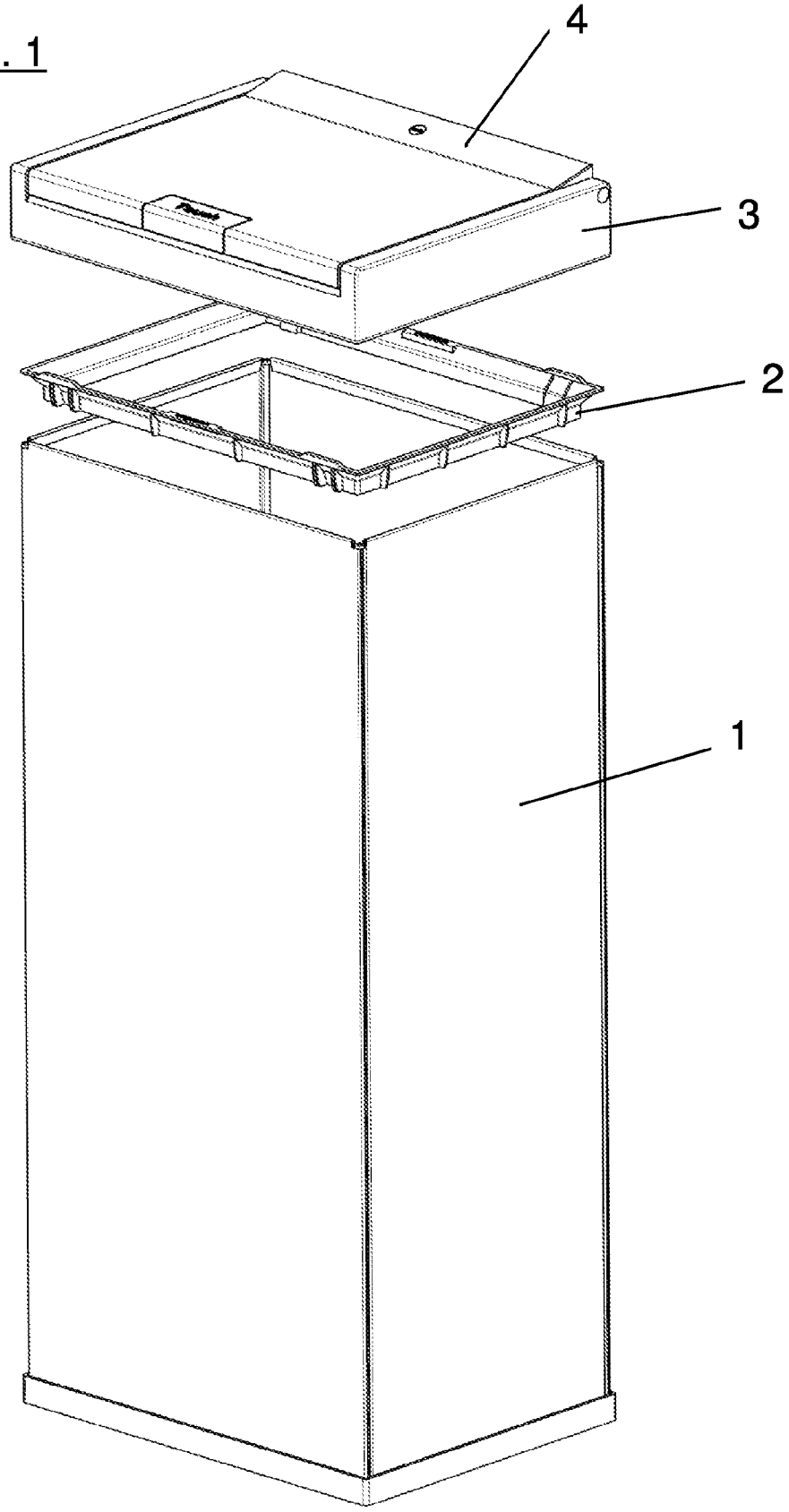
FIG. 1 shows a perspective exploded view of a waste receptacle according to the invention.
Figure 2:
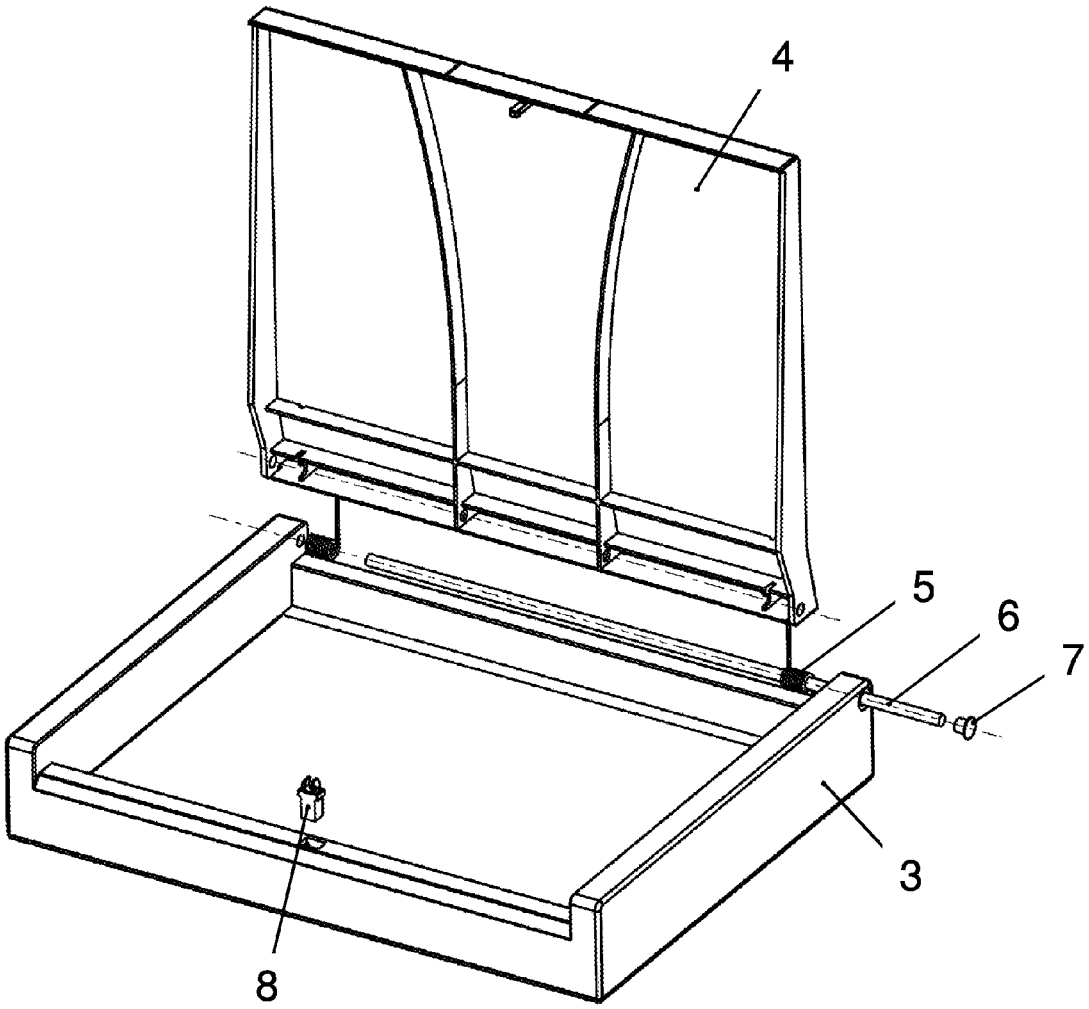
FIG. 2 shows a perspective exploded view of a hood of the waste receptacle as per FIG. 1 comprising a lid and a cover frame.
Figure 3:
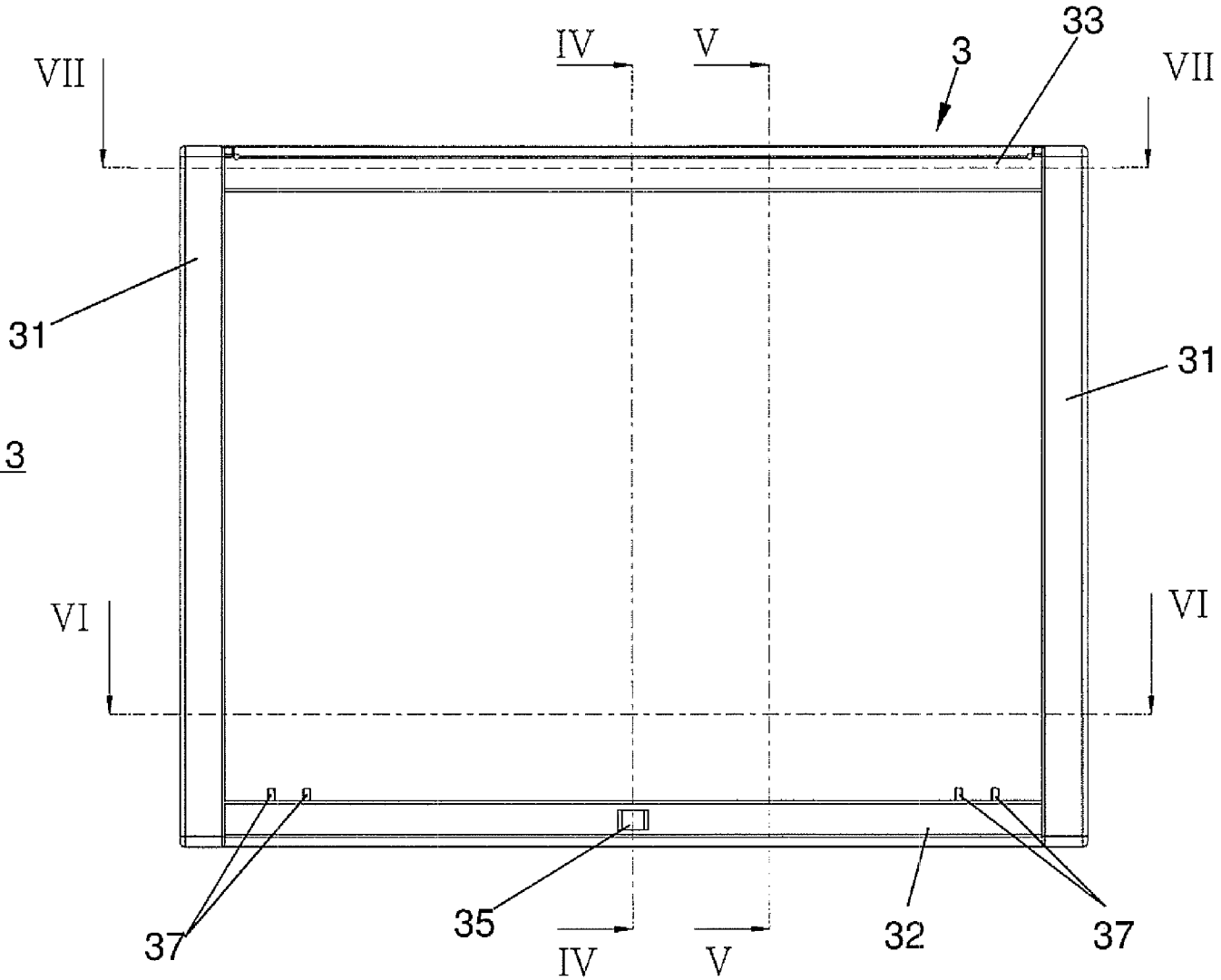
FIG. 3 shows a plan view of the cover frame of the waste receptacle as per FIG. 1.
Figure 4:
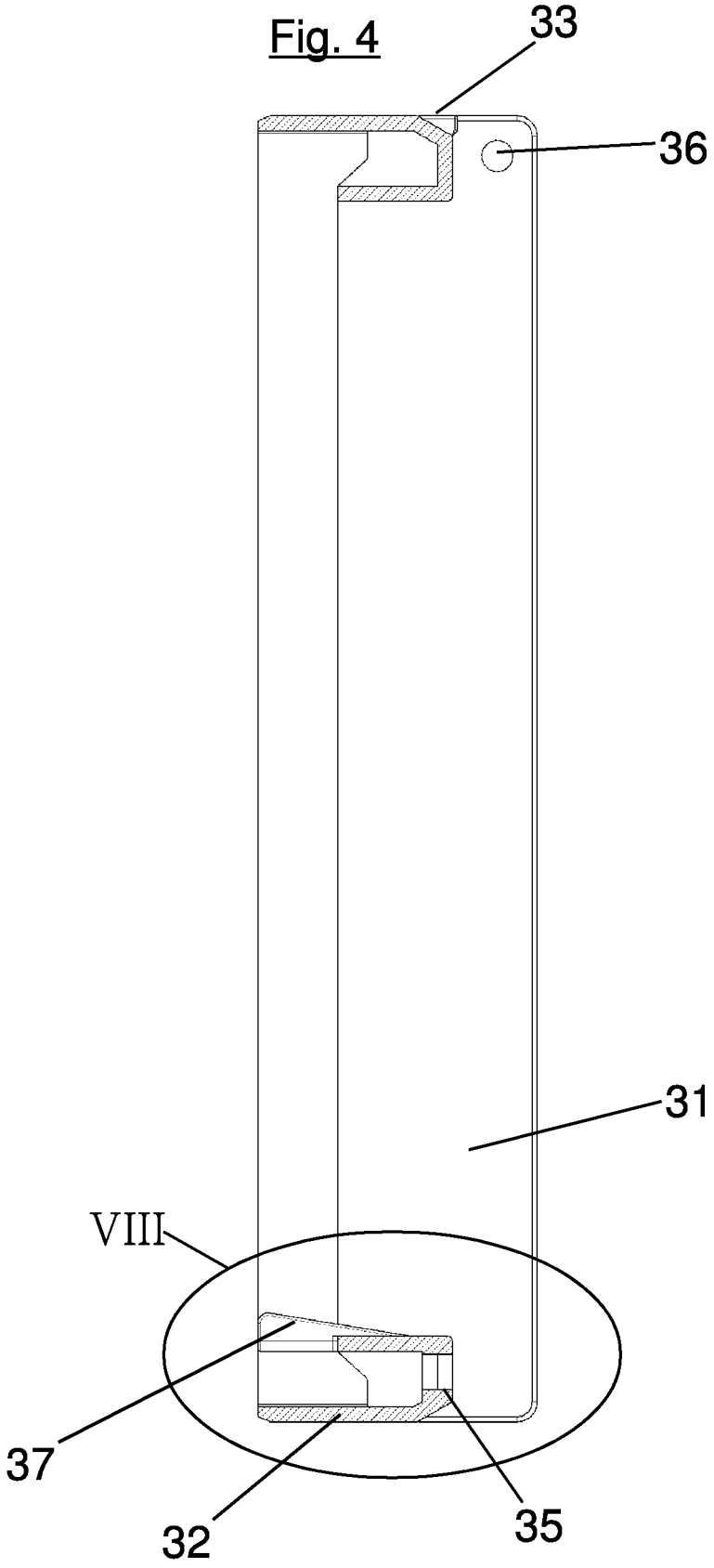
FIG. 4 shows a section through the cover frame along the line IV-IV in FIG. 3.
Figure 5:
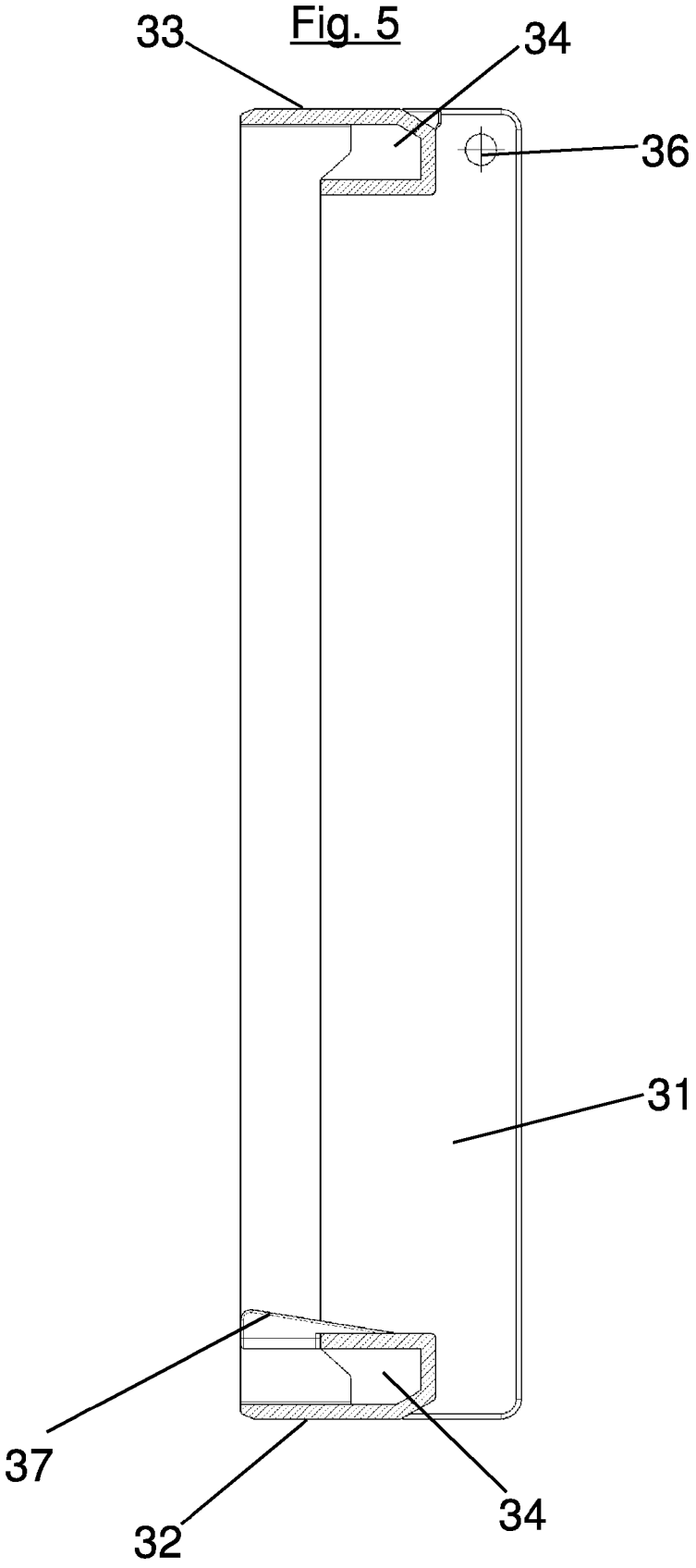
FIG. 5 shows a section through the cover frame along the line V-V in FIG. 3.
Figure 6:
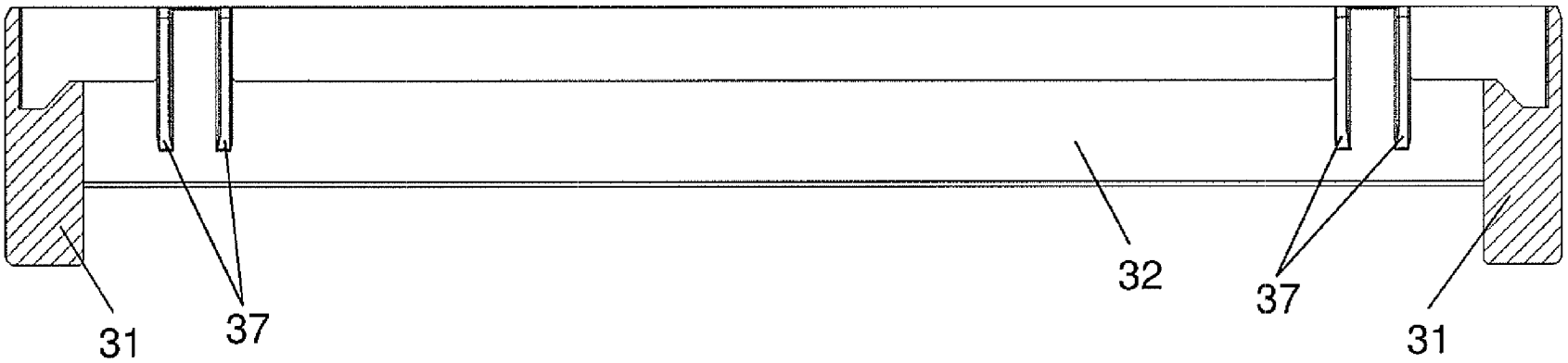
FIG. 6 shows a section through the cover frame along the line VI-VI in FIG. 3.
Figure 7:
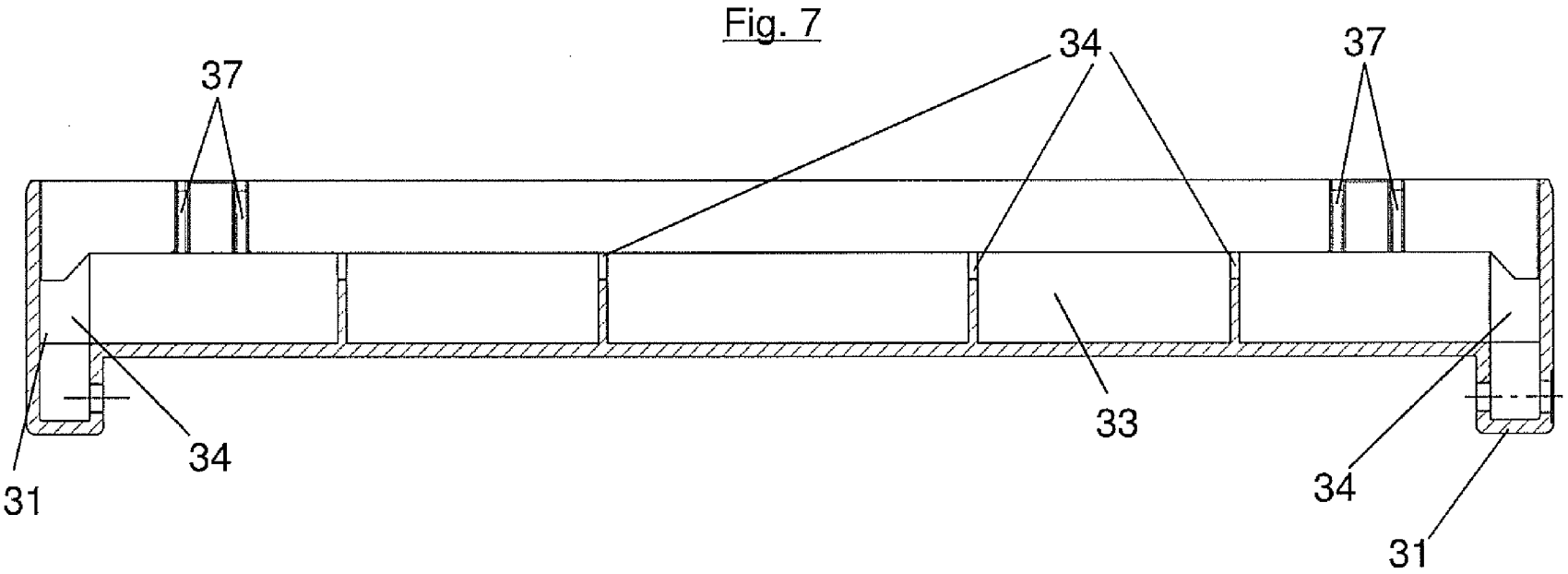
FIG. 7 shows a section through the cover frame along the line VII-VII in FIG. 3.
Figure 8:
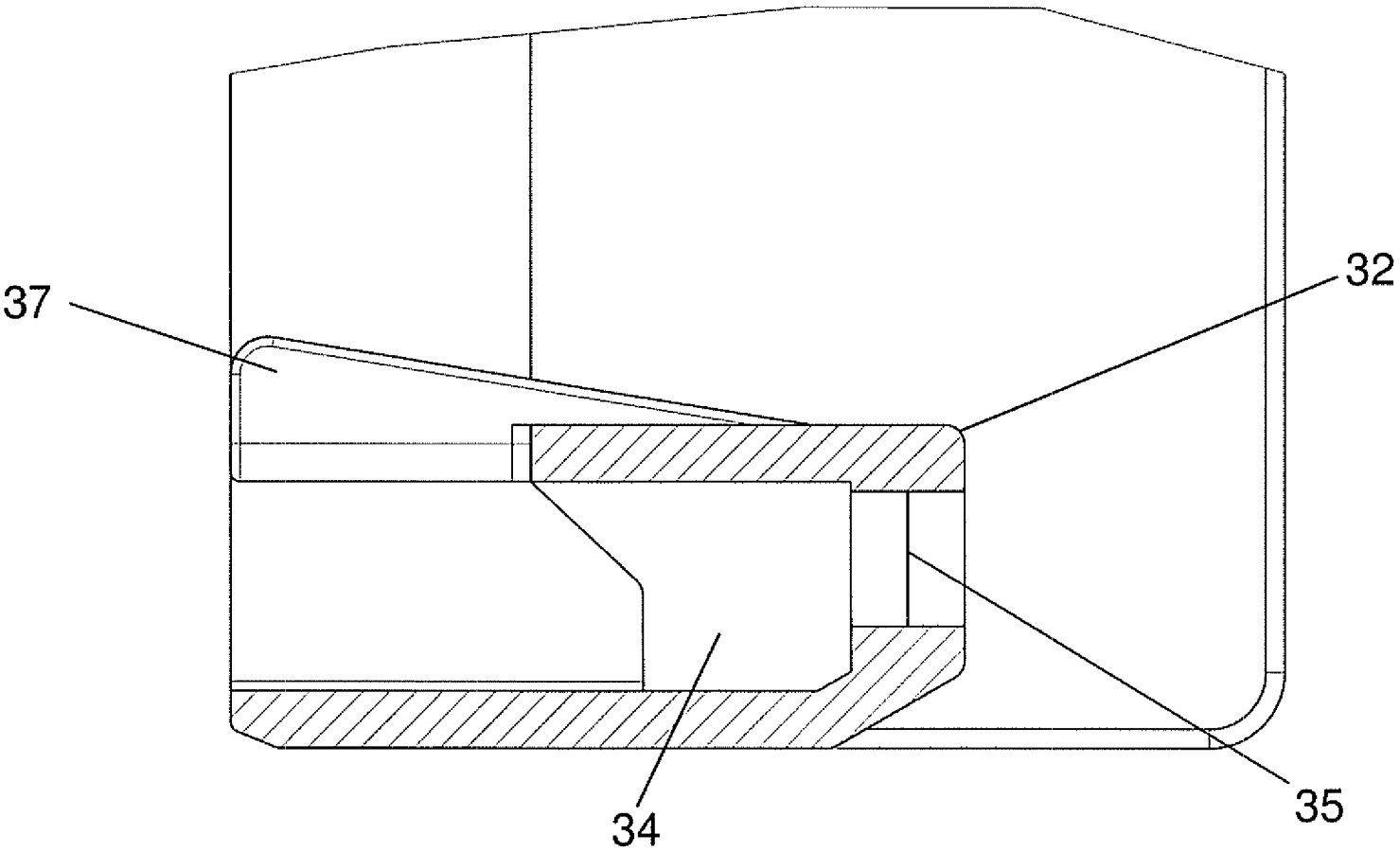
FIG. 8 shows a detail VIII from FIG. 4.
Figure 9:
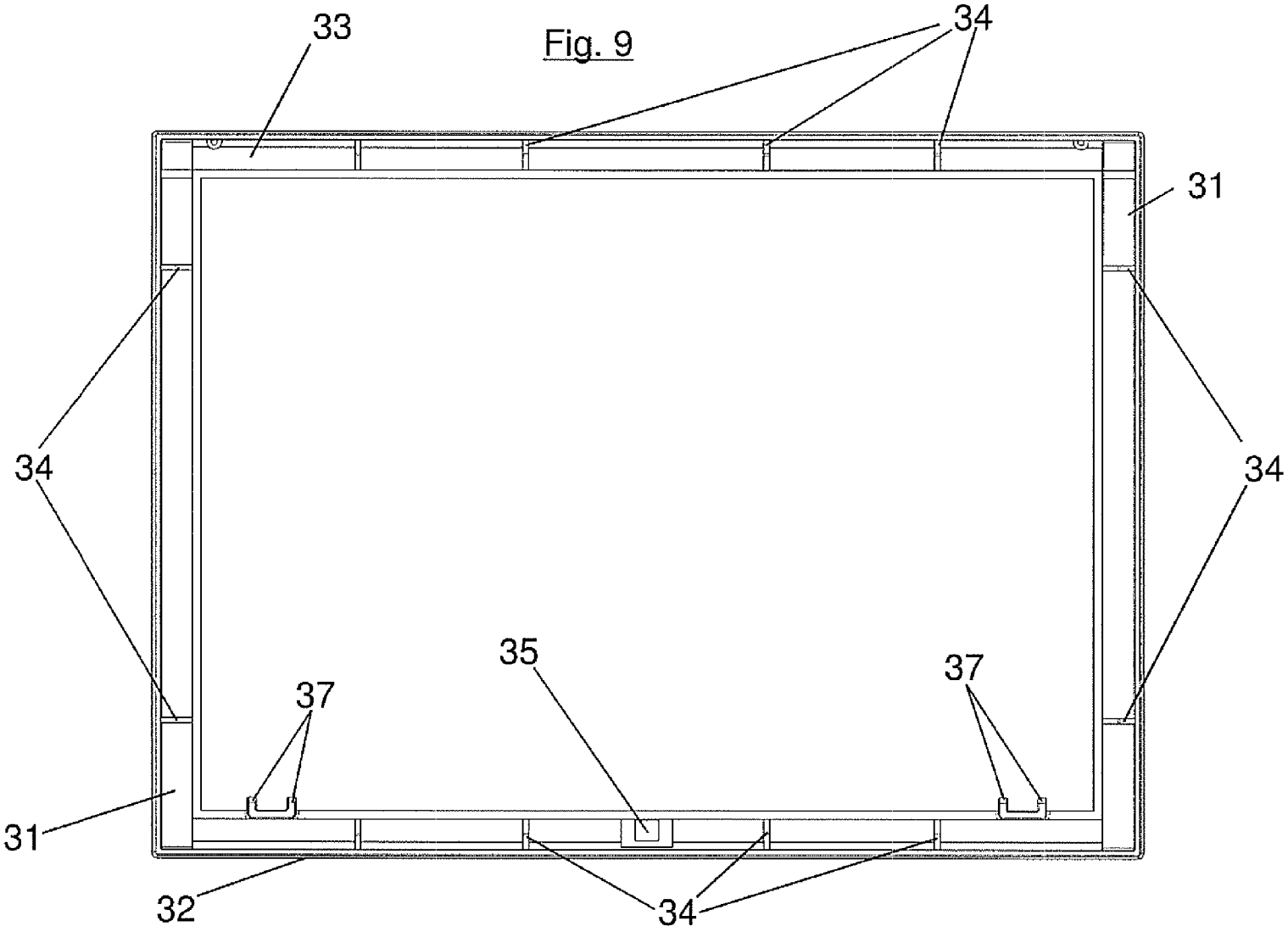
FIG. 9 shows a view of the cover frame, as per FIG. 3 from below.
Figure 10:
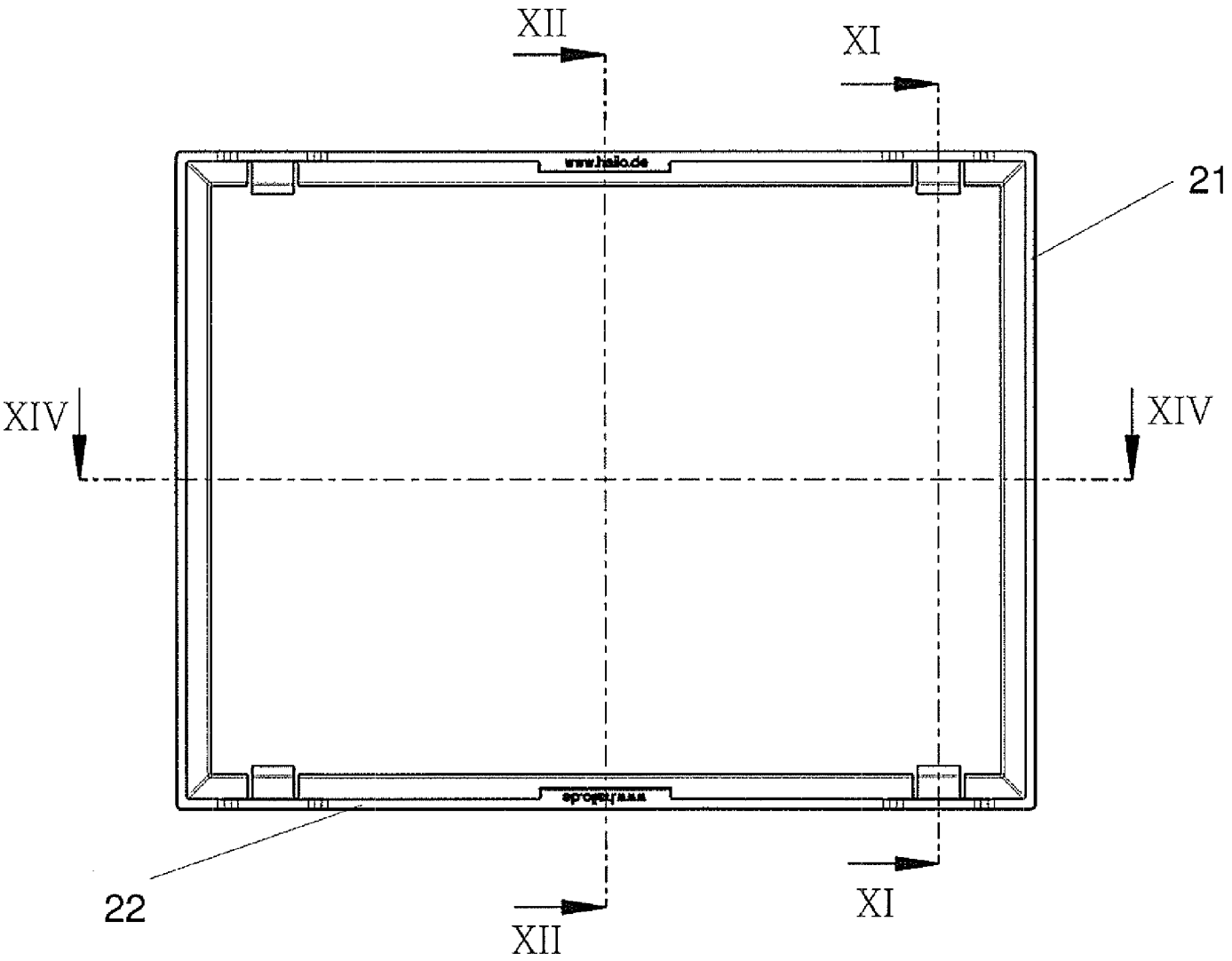
FIG. 10 shows a plan view of the holding frame of the waste receptacle as per FIG. 1.
Figure 11:
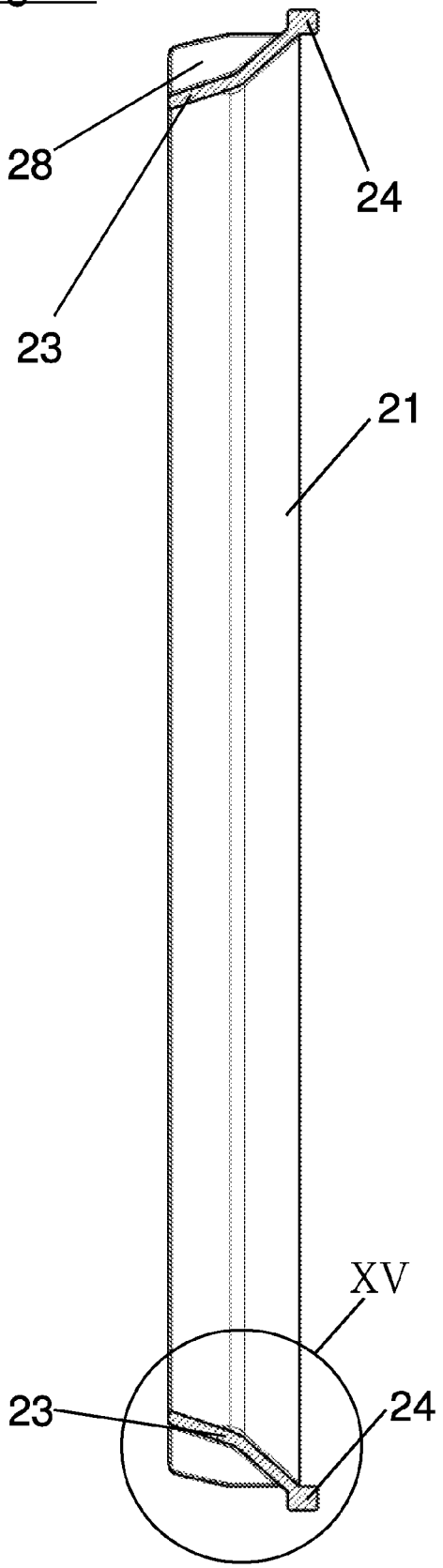
FIG. 11 shows a section through the holding frame along the line XI-XI in FIG. 10.

The waste receptacle represented by way of the figures includes a housing 1, a holding frame 2 and a hood 3, 4, the hood 3, 4 comprising a cover frame 3 and a lid 4. The housing 1 is produced from a metal sheet which is bent and connected to form a cross-sectionally rectangular tube. A lower end of the housing 1 is provided with a foot. At the upper end of the housing there is provided an opening at whose edge the metal sheet of the housing 1 is bent inwardly by about 180° and thus forms a bead.

The holding frame 2 is placed removably on the edge of the opening at the upper end of the housing 1. The holding frame 2 has two first frame parts 21 and two second frame parts 22, the first frame parts 21 being connected to the second frame parts 22 across a corner, and thus forming a rectangular frame when seen in plan view.

Figure 12:
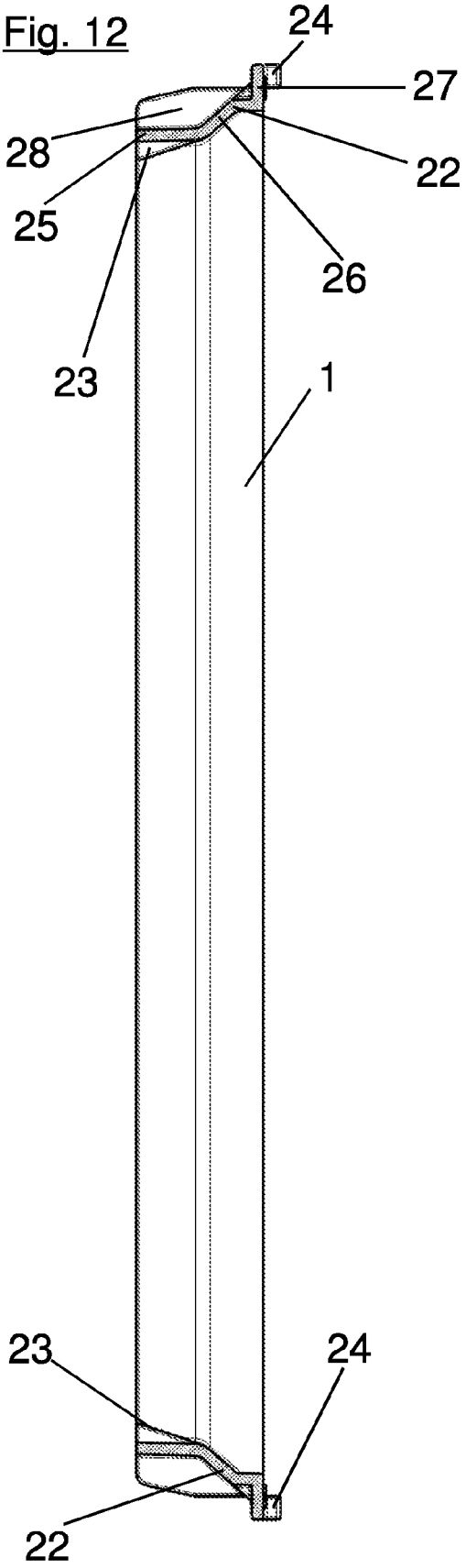
FIG. 12 shows a section through the holding frame along the line XII-XII in FIG. 10.
Figure 13:
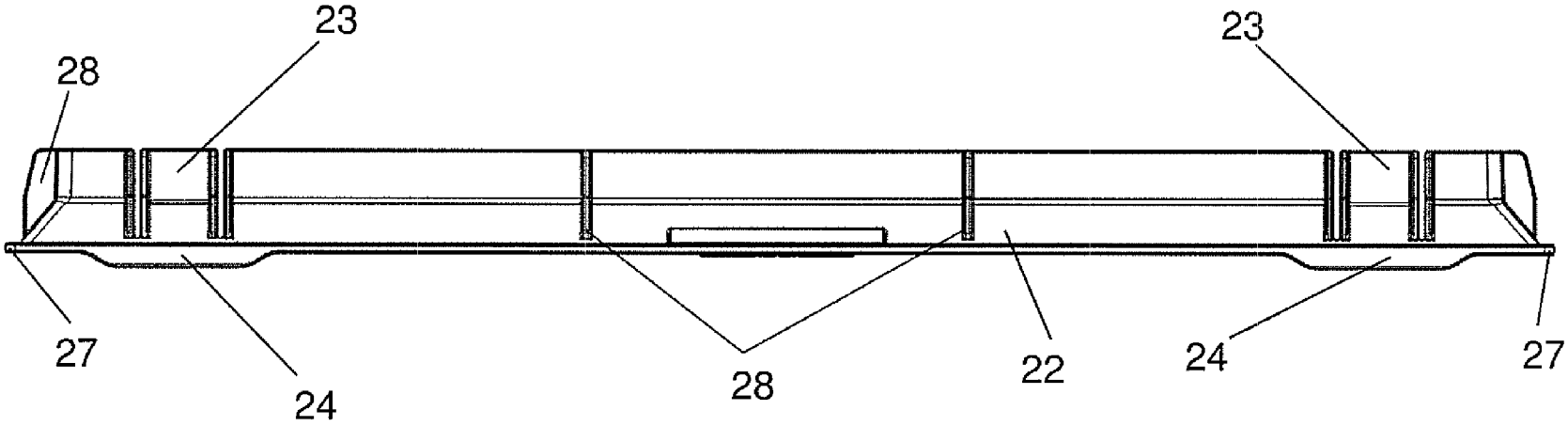
FIG. 13 shows a rear view of the holding frame as per FIG. 10.
Figure 14:
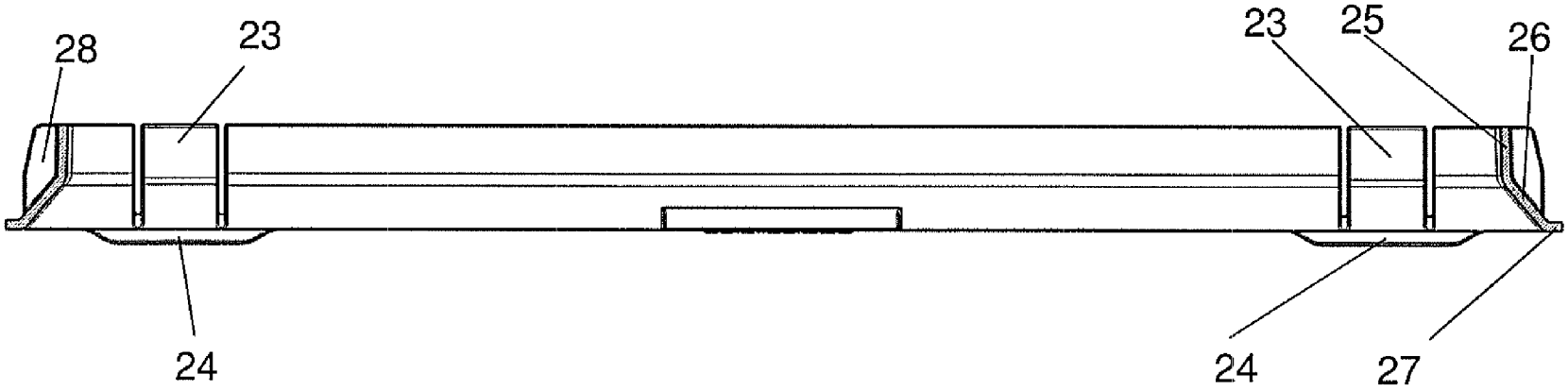
FIG. 14 shows a section through the holding frame along the line XIV-XIV in FIG. 10.
Figure 15:
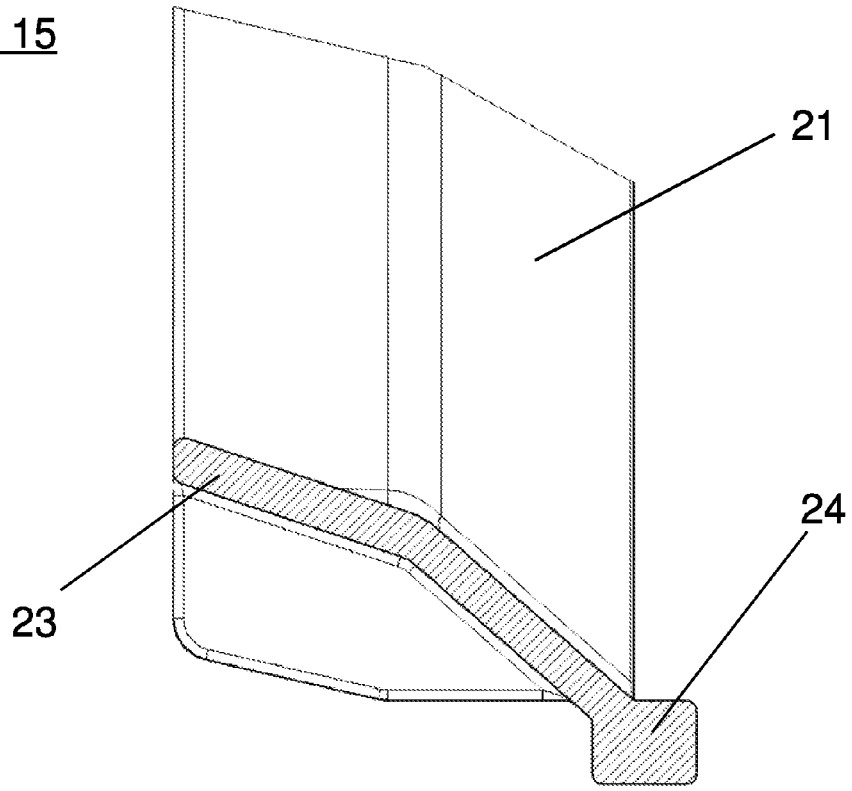
FIG. 15 shows a detail XV from FIG. 11.
Figure 16:
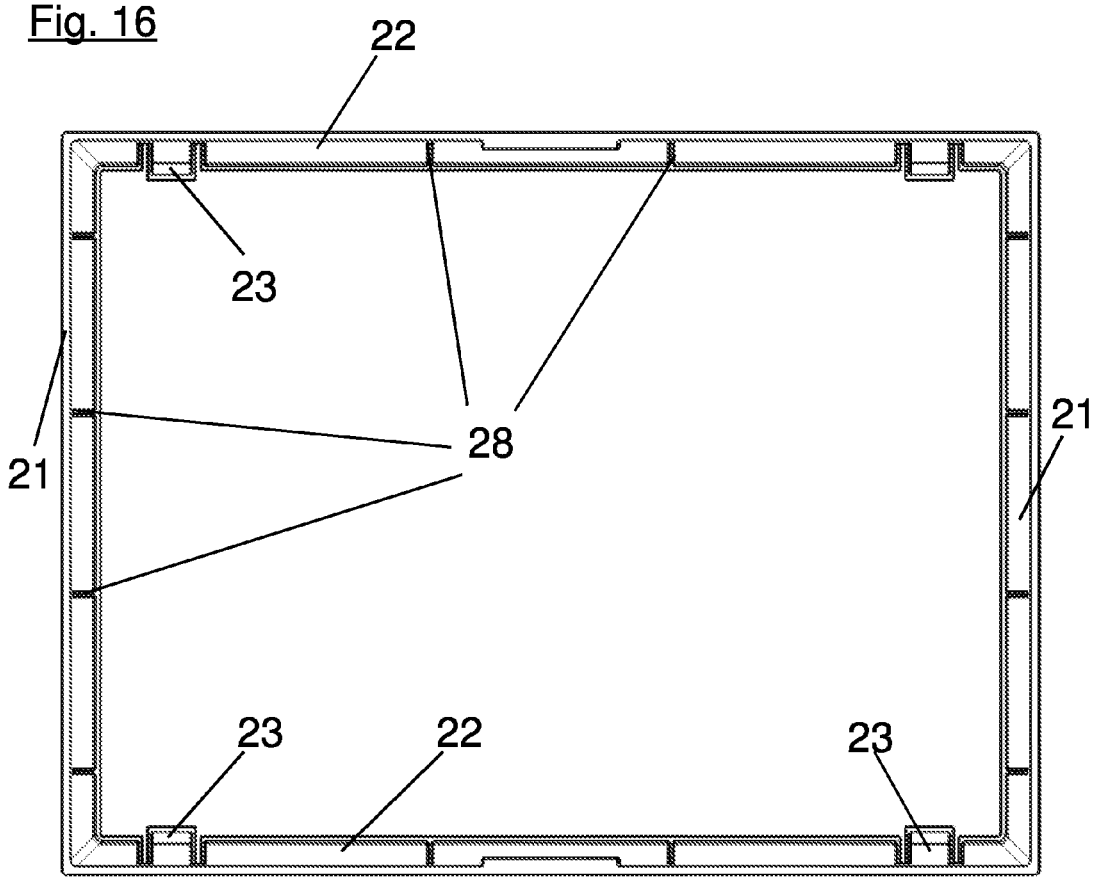
FIG. 16 shows a view of the holding frame as per FIG. 10 from below.
Figure 17:
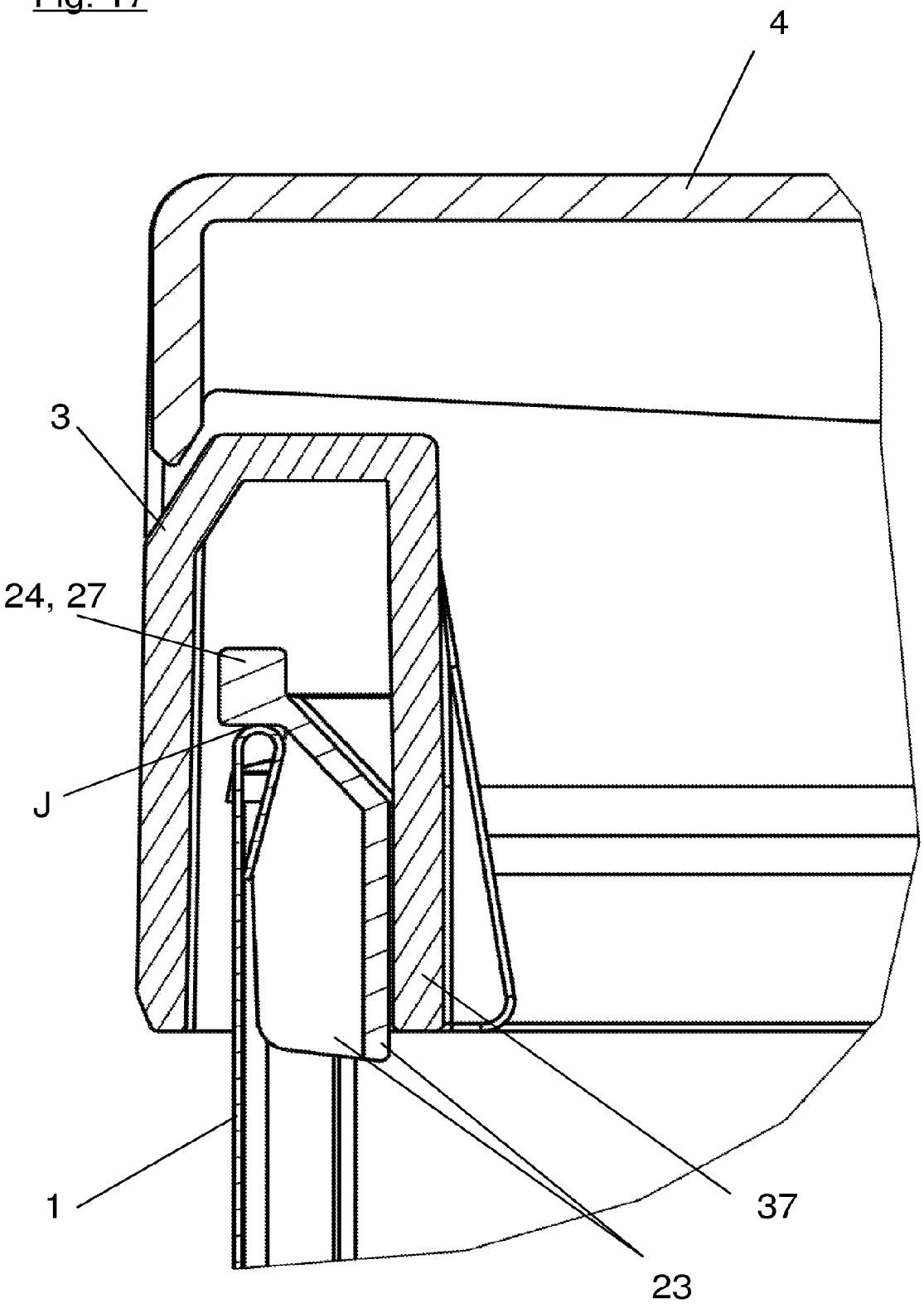
FIG. 17 shows a section through the waste receptacle as per FIG. 1 that corresponds with the cross-sectional view depicted in FIG. 11.

The first frame parts 21 and the second frame parts 22 have an identical cross section, as is represented in particular in FIG. 12 and FIG. 14. A first frame portion 25 which, in the assembled state of the waste receptacle, extends substantially parallel to the side walls of the housing 1 is adjoined by a second frame portion 26 which is angled away outwardly. This second frame portion 26 is adjoined in turn by a third frame portion 27 which extends perpendicularly to the first frame portion 25. The underside of the third frame portion 27 forms a bearing surface by means of which the holding frame 2 bears on the edge of the opening at the upper end of the housing 1.

Webs 28 are provided on the outer side of the first and the second frame portion over the periphery of the holding frame 2, which webs do not project outwardly beyond the third frame portion 27, with the result that the underside of the third frame portion 27, irrespective of the webs 28, can form the bearing surface of the holding frame 2 on the edge of the opening at the upper end of the housing 1. The webs 28 have the function of securing the holding frame 2 against a movement in the opening at the upper end of the housing 1 and thus preventing the holding frame 2 from falling into the housing 1.

Tabs 23 which are extended out of the second frame parts 22 also serve to fasten the holding frame 2 at the upper end of the housing. The tabs 23 have ends which project inwardly with respect to the first frame portions into the second frame parts 22. By means of slots on both sides of the tabs 23, the tabs are separated from the first frame portions 25 and the second frame portions 26 of the second frame parts 22. By contrast, the tabs 23 are fixedly connected to the third frame portions 27. The third frame portions 27 are reinforced by a material thickening 24 in the region of the tabs 23.

The tabs 23 of the holding frame are bent by means of elements of the cover frame 3 around the bead on the edge of the opening at the upper end of the housing, resulting in a positive connection between the holding frame 2, the cover frame 3 and the housing 1. The elements of the cover frame 3 which are involved here will be explained in more detail below.

The cover frame has two lateral frame parts 31, a front frame part 32 and a rear frame part 33. The frame parts 31, 32 and 33 have a substantially downwardly open, U-shaped cross section. The frame parts 31, 32, 33 therefore have a web which forms an upper side of the cover frame, and two legs. The inner side of the legs are connected to one another by means of leg members 34 which impart stability to the cover frame 3. However, the leg members 34 do not extend as far as the lower ends of the legs. The cover frame 3 is thus placed removably on the holding frame 2 such that the upper side of the holding frame 2, which is formed by the upper side of the third frame portions 27, engages in the interspace between the leg members 34 of the frame parts 31, 32, 33. The lower ends of the leg members 34 rest on the upper side of the holding frame 2.

The outer leg of the frame parts 31, 32, 33 projects beyond the inner leg and also projects beyond a gap between the holding frame 2 and the outer side of the housing 1 if the holding frame 2 and the cover frame 3 are placed on the housing. With the cover frame 3 placed, the holding frame 2 is thus not visible from the side and is only visible from above with limitations. Thus, the third frame portion 27 for example is not visible.

The cover frame 3 has cantilever arms 37 as elements for bending the tabs 23 of the holding frame 2 around the bead at the edge of the opening at the upper end of the housing 1. These cantilever arms are provided on the inner side of the front and rear frame parts 32, 33. The cantilever arms 37 clamp in the holding frame 2 and a refuse bag placed around the holding frame and the cover frame 3 is at least positively connected to the housing 1.

The lateral frame parts 31 are higher than the front and the rear frame part 32, 33. The lid 4 has a width which is selected such that the lid 4 fits between the two lateral frame parts 31 and can rest horizontally between the two lateral frame parts 31 on the front and the rear frame part 32, 33.

The lid is pivotably mounted in bushes 36 via a pivot pin 6, the bushes 36 being provided at the rear end of the lateral frame parts 31 of the cover frame 3. The pivot pin 6 extends above the rear frame part 33. The pivot pin 6 is secured against axial displacement in the bushes by means of plugs 7.

Leg springs 5 which are arranged on the pivot pin 6 have the effect that the lid 4 is moved into an open state. If it is intended for the lid 4 to be closed, it is necessary to press the lid 4 against the pressure of the leg springs 5. In the closed state, the lid 4 is then retained by a so-called push-push element 8 which is known per se and which is inserted in a recess 35 in the front frame part 32. By pressing on the closed lid 4, the lid can be opened.

We claim:

1. A waste receptacle comprising:

a housing which has an opening at least on one side;

a holding frame for a refuse bag, the holding frame being placed removably on an edge of the opening of the housing, the holding frame having:

a first frame portion that extends substantially parallel to a wall of the housing, a second frame portion that adjoins the first frame portion and is angled away outwardly with respect to the first frame portion, webs disposed on the outer side of the first and second frame portion, and a third frame portion that projects outwardly beyond the webs; and a cover frame, wherein the cover frame is placed removably on the holding frame, wherein the cover frame covers:

all side portions of the holding frame which are visible from the side of the receptacle and all side portions of the holding frame over which a refuse bag is guided.

2. The waste receptacle according to claim 1, wherein the cover frame encloses an insertion opening which is suitable and designed for inserting waste into a refuse bag which can be fastened between the housing and the holding frame and also between the holding frame and the cover frame.

3. The waste receptacle according to claim 2, wherein the waste receptacle has a lid for closing the insertion opening, which lid is pivotably mounted on the cover frame or is placed removably on the cover frame.

4. The waste receptacle according to claim 3, wherein the waste receptacle has a mechanism which is suitable and designed for bringing the lid from a position in which the insertion opening is closed into a position in which the insertion opening can be used to insert waste when pressure is exerted onto the lid on an opposite side thereof from a pivot pin.

5. The waste receptacle according to claim 1, the third frame portion which extends substantially perpendicularly to the first frame portion and which adjoins the second frame portion in an outwardly projecting manner.

6. The waste receptacle according to claim 1, wherein the holding frame has tabs which are extended inwardly from the second frame portion.

7. The waste receptacle according to claim 6, wherein the third frame portion is reinforced in the region of the tabs.

8. The waste receptacle according to claim 6, wherein the cover frame has cantilever arms which press the tabs of the holding frame outwardly against an inner wall of the housing.

9. The waste receptacle accordingly to claim 6, wherein the housing has a bead on the inner side of the edge of the opening, and in that the tabs of the holding frame project beyond this bead in the direction facing away from the opening of the housing.

10. A waste receptacle comprising:

a housing including an opening at one end of the housing, wherein the housing is configured to receive and retain a refuse bag;

a holding frame for the refuse bag, the holding frame having:

a first frame portion that extends substantially parallel to a wall of the housing, a second frame portion that adjoins the first frame portion and is angled away outwardly with respect to the first frame portion, webs disposed on the outer side of the first and second frame portion, and a third frame portion that projects outwardly beyond the webs, wherein the holding frame is configured to be removably placed on an edge of the opening of the housing such that the first, second, and third portions of the holding frame fit within the housing; and a cover frame configured to be removably placed on the holding frame, wherein the cover frame covers the holding frame and further extends around side wall portions of the housing such that, upon installation of the holding frame and cover frame with the housing, the holding frame is not visible at all exterior portions of the waste receptacle.

* * * * *